US006941692B1

(12) United States Patent
Krinke et al.

(10) Patent No.: US 6,941,692 B1
(45) Date of Patent: Sep. 13, 2005

(54) FIREARM SAFETY MECHANISM

(76) Inventors: Alvern J. Krinke, 12185 Fletcher La., Rogers, MN (US) 55374; Thomas A. Krinke, Rte. 3, Box 92, Houston, MN (US) 55943

( * ) Notice: Subject to any disclaimer, the term of this patent is extended or adjusted under 35 U.S.C. 154(b) by 0 days.

(21) Appl. No.: 10/460,748

(22) Filed: Jun. 12, 2003

Related U.S. Application Data

(60) Provisional application No. 60/388,215, filed on Jun. 13, 2002, provisional application No. 60/478,071, filed on Jun. 12, 2003.

(51) Int. Cl.[7] ..... F41A 17/24
(52) U.S. Cl. ..... 42/70.08; 42/70.11
(58) Field of Search ..... 42/70.08, 70.06, 42/70.05, 70.03, 70.04, 70.11

(56) References Cited

U.S. PATENT DOCUMENTS

| | | | | |
|---|---|---|---|---|
| 1,294,186 A | * | 2/1919 | Stava | 42/70.08 |
| 2,803,910 A | * | 8/1957 | Lyle | 42/70.08 |
| 3,673,725 A | * | 7/1972 | Cravener | 42/70.11 |
| 4,763,431 A | * | 8/1988 | Allan et al. | 42/70.11 |
| 4,967,502 A | * | 11/1990 | Vernon | 42/70.08 |
| 5,036,612 A | | 8/1991 | Jennings | |
| 5,223,649 A | | 6/1993 | Claridge | |
| 5,225,612 A | | 7/1993 | Bernkrant | |
| 5,251,394 A | | 10/1993 | Bornancini | |
| 5,259,138 A | | 11/1993 | Scirica | |
| 5,361,525 A | * | 11/1994 | Bowes | 42/70.11 |
| 5,488,794 A | | 2/1996 | Arrequin | |
| 5,517,780 A | | 5/1996 | Haber et al. | |
| 5,704,152 A | | 1/1998 | Harrison et al. | |
| 5,732,497 A | | 3/1998 | Brooks | |
| 5,749,166 A | | 5/1998 | Brooks | |
| 5,758,524 A | | 6/1998 | Yu | |
| 5,782,028 A | | 7/1998 | Simon et al. | |
| 5,826,362 A | | 10/1998 | Lyons | |
| 5,913,666 A | | 6/1999 | Perkins | |
| 5,950,344 A | | 9/1999 | Ross | |
| 6,212,813 B1 | | 4/2001 | Luna et al. | |

(Continued)

FOREIGN PATENT DOCUMENTS

DE 33 42 116 A1 * 6/1985

OTHER PUBLICATIONS

Parts Diagram & Description, printed from website: http://www.m1911.org/partname.htm, 3 pages, dated May 30, 2003.

*Primary Examiner*—Stephen M. Johnson
(74) *Attorney, Agent, or Firm*—Patterson, Thuente, Skaar & Christensen, P.A.

(57) ABSTRACT

A safety mechanism for a firearm with a lock pivotally attached to the firearm and an insertable key, which is disposable in the lock. In an off-safe position, the key is disposed within the lock and the lock is held against the firearm when a user grasps a handle portion of the firearm. When the lock is no longer being held against the firearm, the lock pivots away from the firearm and the key is ejected from the lock, such that the lock is in an on-safe position. When the key is absent from within the lock, the lock cannot be pivoted toward the firearm. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

20 Claims, 8 Drawing Sheets

U.S. PATENT DOCUMENTS 6,256,918 B1 7/2001 Szabo
6,269,576 B1 8/2001 Williams
6,347,538 B1 2/2002 Doiron
6,357,155 B1 * 3/2002 Amadini ..... 42/70.11
6,374,526 B1 4/2002 Mochak
6,405,468 B1 6/2002 Gilgenbach
6,415,702 B1 7/2002 Szabo et al.
6,463,689 B1 10/2002 McElroy
6,487,804 B1 12/2002 Petrella, Jr.
6,510,639 B2 1/2003 McMoore
6,510,641 B1 1/2003 Viani
6,513,273 B2 2/2003 da Silveira
6,530,168 B2 3/2003 Shimi et al.
6,539,658 B1 4/2003 Hubert et al.
6,543,170 B2 4/2003 Beretta
6,629,379 B1 * 10/2003 Doiron ..... 42/70.11
2002/0059746 A1 5/2002 Ross et al.

* cited by examiner

FIREARM SAFETY MECHANISM

CROSS-REFERENCES TO RELATED APPLICATIONS

This application claims priority under 35 U.S.C. § 119 (e) to, and hereby incorporates by reference, U.S. Provisional Application Ser. No. 60/388,215, filed Jun. 13, 2002 and U.S. Provisional Application Ser. No. 60/478,071, filed Jun. 12, 2003.

BACKGROUND OF THE INVENTION

1. Field of the Invention

This invention relates to safety mechanisms and, in particular, this invention relates to safety mechanisms for firearms.

2. Background

Virtually every firearm possesses at least one safety mechanism. These safety mechanisms prevent the firearm from being operated when the safety mechanism is in what may be termed an "on-safe" position. The safety mechanism may block a component, such as a trigger, trigger bar, hammer, or firing pin, from being displaced. Thus, if pressure is inadvertently applied to the trigger, one of the foregoing components cannot be displaced and the firearms is not unintentionally fired. Other safety mechanisms have been proposed to augment or replace the foregoing mechanical mechanisms. Some of these other safety mechanisms examine the user's fingerprints to match a predetermined fingerprint pattern before the firearm can be utilized. Another safety mechanism includes a transponder and requires a specified electromagnetic source, e.g., worn as a wrist band, proximate the transponder to activate the safety mechanism before the firearm can be fired. Other technologies proposed to augment traditional mechanical safety mechanisms utilize mechanical combination locks, electromechanical locks, electromagnetic locks and magnetic locks. While the foregoing technologies potentially enhance the safety of firearms, they lack the dependability inherent in safety mechanisms employing only mechanical components. For example, the foregoing additional mechanisms usually require electricity for operation. The required electricity will almost certainly be obtained from batteries, the batteries, in turn, exhaustible. Hence, firearm safeties utilizing electrical components may be inoperable if batteries are exhausted.

Another concern regarding currently available safety mechanisms for firearms is that none of the known mechanical safety mechanisms automatically disarms a firearm when not being gripped by a user, such that the firearm cannot be re-grasped and fired. Instead, a user must manually adjust the safety mechanism of some mechanical mechanisms between an on-safe or off-safe position. In other mechanical safety mechanisms, a safety is present at locations where the firearm is normally grasped, e.g., at the grip of a semi-automatic pistol. Typically, grasping the firearm pivots the safety into an off-safe position, thereby allowing the firearm to be fired. However, an unintended user can grasp and use a firearm previously in an on-safe position, because the unintended user is not required to bring the firearm to an off-safe position by performing any subsequent mechanical step.

There is then a need for a firearm safety mechanism which is self-disarming. There is a particular need for a firearm safety mechanism which is self-disarming and is completely composed of mechanical components and in which a subsequent mechanical step must be performed before the safety mechanism can be adjusted to an off-safe position.

SUMMARY OF THE INVENTION

This invention substantially meets the aforementioned needs of the industry by providing an entirely mechanical safety mechanism for firearms, which prevents the firearm from being fired when the firearm is not being grasped and which requires a further mechanical step before the safety mechanism can be adjusted to an off-safe position.

It is therefore an object of this invention, to provide a safety mechanism for a firearm including a lock, an ejection mechanism, and a key. The lock cooperates with a structure firing the firearm. The key may be insertable into the lock such that the key may be ejected from the lock by the ejection mechanism unless secured therein, e.g., against a surface of the firearm.

A further object is to provide a process of installing or retrofitting a safety assembly in a firearm. The process may include 1) pivotably affixing a lock to the firearm; 2) biasing the lock away from a firearm; and 3) providing a key, the key insertable into the lock.

One feature of particular embodiments of the invention is that the present safety mechanism is comprised entirely of mechanical components.

A corresponding advantage of the foregoing feature is that the present safety mechanism does not rely on electrical or electromagnetic energy, which must be supplied by exhaustible batteries.

Another feature of the present safety mechanism is that a component pivots away from the firearm when the firearm is not being grasped by a user.

A corresponding advantage of the foregoing feature is that the firearm is automatically disarmed when not being grasped.

Yet another feature of the present safety mechanism is that the pivotable component ejects a key when pivoting away from the firearm and that the pivotable component cannot be pivoted toward the firearm unless the key is disposed within the pivotable component.

One corresponding advantage of the foregoing feature is that the present safety mechanism cannot be activated to an off-safe position by persons not possessing the key.

Yet still another feature of one embodiment of the present safety mechanism is that the pivotable component can be retained in a position proximate the firearm when a separate safety is in an on-safe position, whether or not the firearm is being grasped.

One corresponding advantage of the foregoing feature is that the firearm may be placed in a holster without being deactivated by the present safety mechanism.

Another corresponding advantage of the foregoing feature is that the firearm may be released by a user without deactivating the firearm, when the present safety assembly is in an off-safe position.

These and other objects, features, and advantages of this invention will become apparent from the description which follows, when considered in view of the accompanying drawings.

It is understood that the above-described figures are only illustrative of the present invention and are not contemplated to limit the scope thereof.

DETAILED DESCRIPTION

Any references to such relative terms as upper, or the like, are intended for convenience of description and are not intended to limit the present invention or its components to any one positional or spatial orientation.

Each of the additional features and methods disclosed herein may be utilized separately or in conjunction with other features and methods to provide improved safety mechanisms and methods for making and using the same. Representative examples of the teachings of the present invention, which examples utilize many of these additional features and methods in conjunction, will now be described in detail with reference to the drawings. This detailed description is merely intended to teach a person of skill in the art further details for practicing preferred aspects of the present teachings and is not intended to limit the scope of the invention. Therefore, combinations of features and methods disclosed in the following detailed description may not be necessary to practice the invention in the broadest sense, and are instead taught merely to particularly describe representative and preferred embodiments of the invention.

The present invention includes a safety assembly for a firearm such as a semi-automatic pistol, a revolver, a bolt action rifle, a semi-automatic rifle, automatic firearms employing fire control mechanisms known to persons of skill in the art, and to shotguns with any of the foregoing firing mechanisms.

In its broadest sense, the present safety assembly provides a component, which may be ejected from the firearm, thereby placing the firearm in an on-safe position. The ejectable component may be held in place by such means as a user gripping a handle of a firearm utilizing the present safety assembly.

In another sense, the present safety assembly employs a pivotable component which receives the ejectable component. The pivotable component is biased away from the firearm. When biased away from the firearm, the pivotable component is in a on-safe position and the firearm cannot be operated. To operate a firearm utilizing the present pivotable component, the pivotable component must be retained proximate the firearm in an off-safe position and the ejectable component must be disposed within the pivotable component. If the pivotable component is allowed to pivot away from the firearm, the firearm cannot be operated because the pivotable component and the firearm are in an on-safe position. Moreover, the ejectable component may be simultaneously ejected from the pivotable component as the pivotable component pivots away from the firearm. In the absence of the ejectable component, the pivotable component cannot be pivoted proximate the firearm to an off-safe position.

Figure 1:
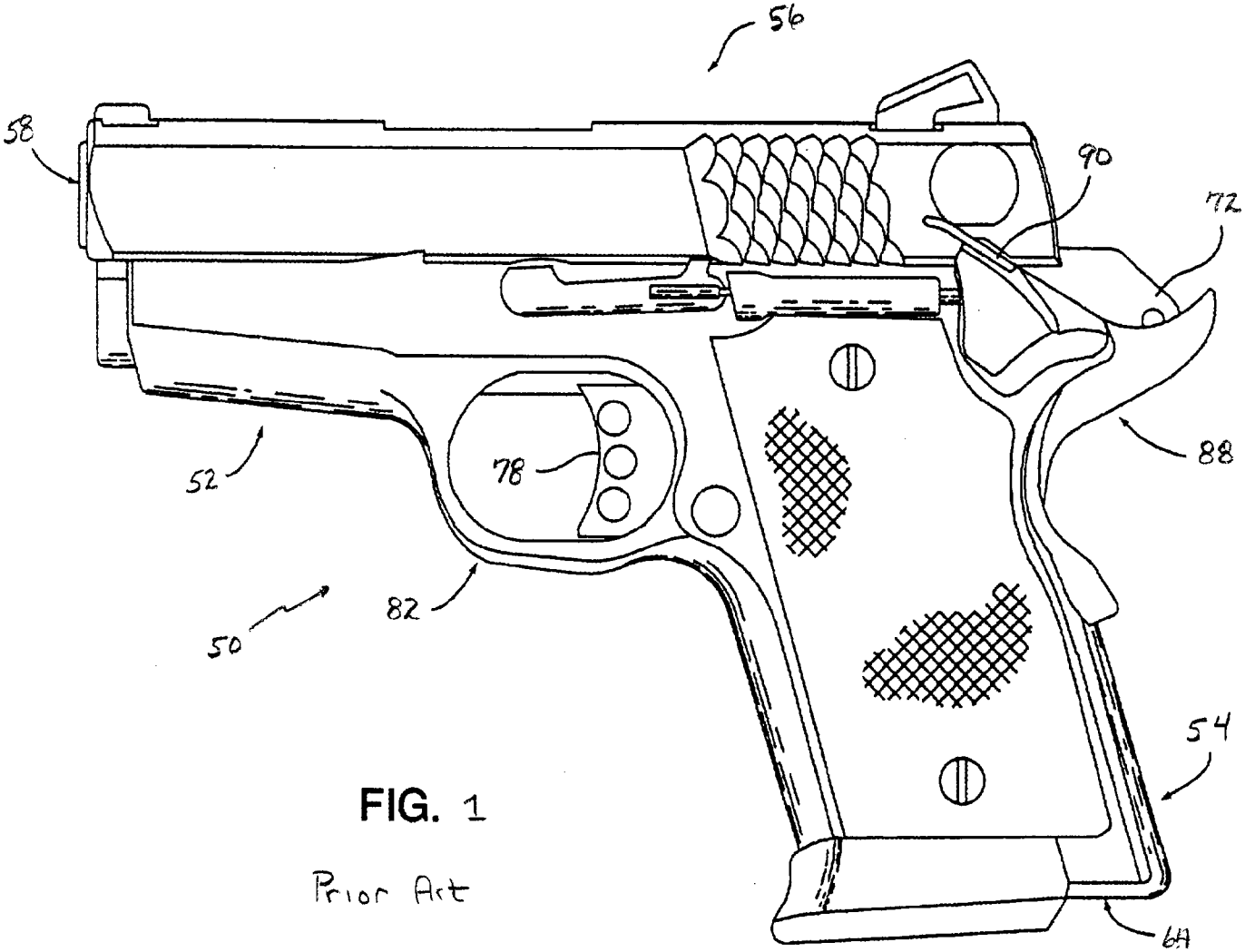
FIG. 1 Prior Art
FIG. 1 is a side view of a semi-automatic pistol of the prior art.
Figure 2:
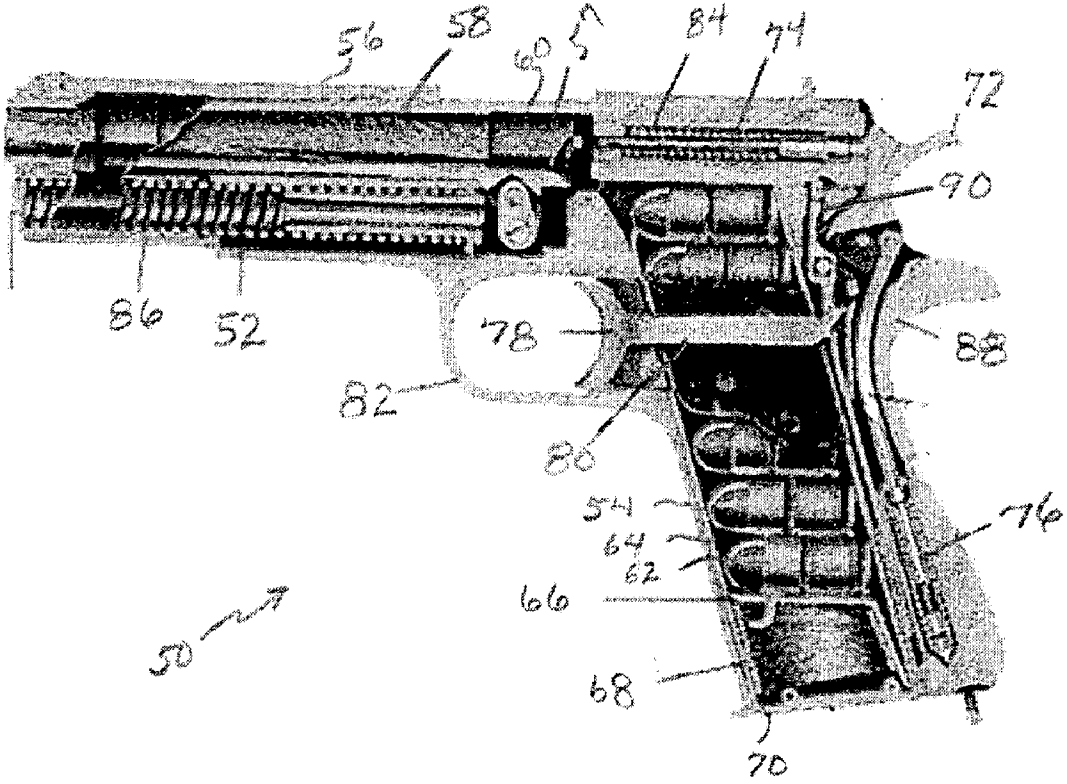
Fig. 2 Prior Art
FIG. 2 is a partial cross sectional view of another semi-automatic pistol of the prior art.

FIGS. 1 and 2 depict a semi-automatic pistol known to persons of ordinary skill in the art and to which the present invention may be installed as original equipment or retrofitted. Obviously, a person of ordinary skill in the art would also be able to retrofit other firearms, e.g., revolvers, rifles, shotguns, to operably accommodate the present safety system without undue experimentation. In FIGS. 1 and 2, the semi-automatic pistol is shown generally at 50 and includes a frame 52 with a grip portion 54, and a breech-slide 56 with a breech block 57 movably connected to the frame to enable foreword and rearward movement with respect to the frame 52 and the slide 56. A barrel 58 is mounted atop the frame 52. The barrel 58 includes a chamber 60 dimensioned to accommodate a cartridge 62. A magazine 64 holds numerous cartridges 62. The magazine 64 feeds the cartridges 62 by urging the cartridges toward the breech block 57 via a follower 66 and spring 68. The cartridges 62 are fed into the chamber 60 responsive to the movement of the slide 56. The magazine 64 is removably inserted into a magazine receiver 70 defined within the grip 54 of the pistol 50. The pistol 50 typically has a hammer 72 for striking a firing pin 74, which, in turn, strikes a primer (not shown) of a cartridge 62, when the cartridge 62 disposed within the chamber 60. A main spring 76 biases the hammer 72 toward the firing pin 74. A trigger 78 is connected to a trigger bar 80 that cooperates with a mechanical linkage (not shown) to release the cocked hammer to strike the firing pin, which consequently strikes the primer of the cartridge 62. The trigger 78 is positioned within a trigger guard 82. An extractor 84 and an injector system (not shown) eject a spent shell (or casing) from the open breech and a recoil spring 86 returns the slide 56 to a foreword and breech-closed position after the pistol 50 has been fired. Safety mechanisms usually present include a grip safety 88 and a thumb lever safety 90. The grip safety 88 normally locks the trigger 78, or otherwise prevents discharge of the cartridge, until the grip 54 of the pistol is grasped by a user's hand. The thumb lever safety 90 locks the trigger 78 (or other firing components) when pivoted into the on-safe position.

Figure 3:
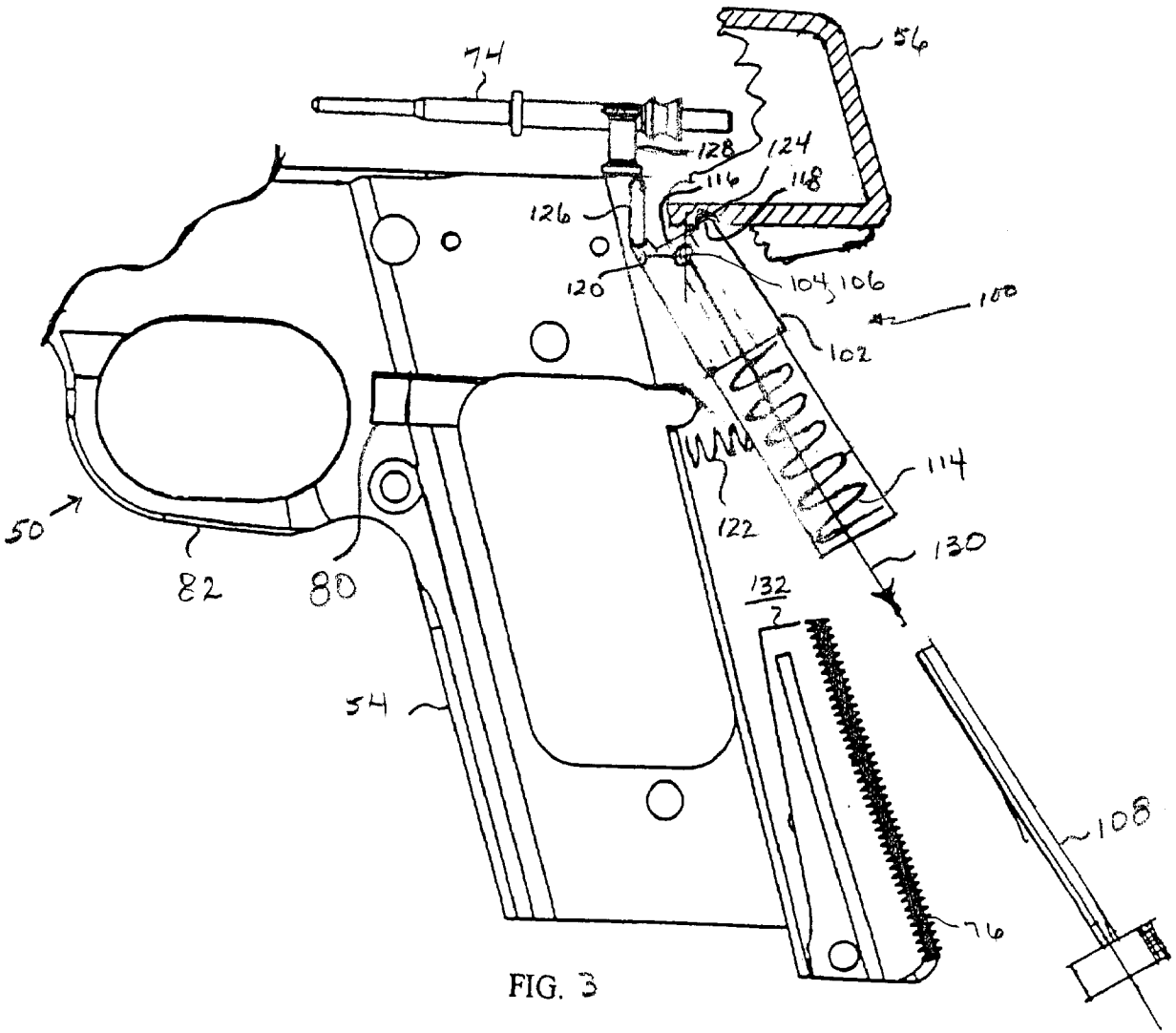
FIG. 3 is a partial side view of a pistol retrofitted or installed with one embodiment of the present safety assembly in an on-safe position.
Figure 4:
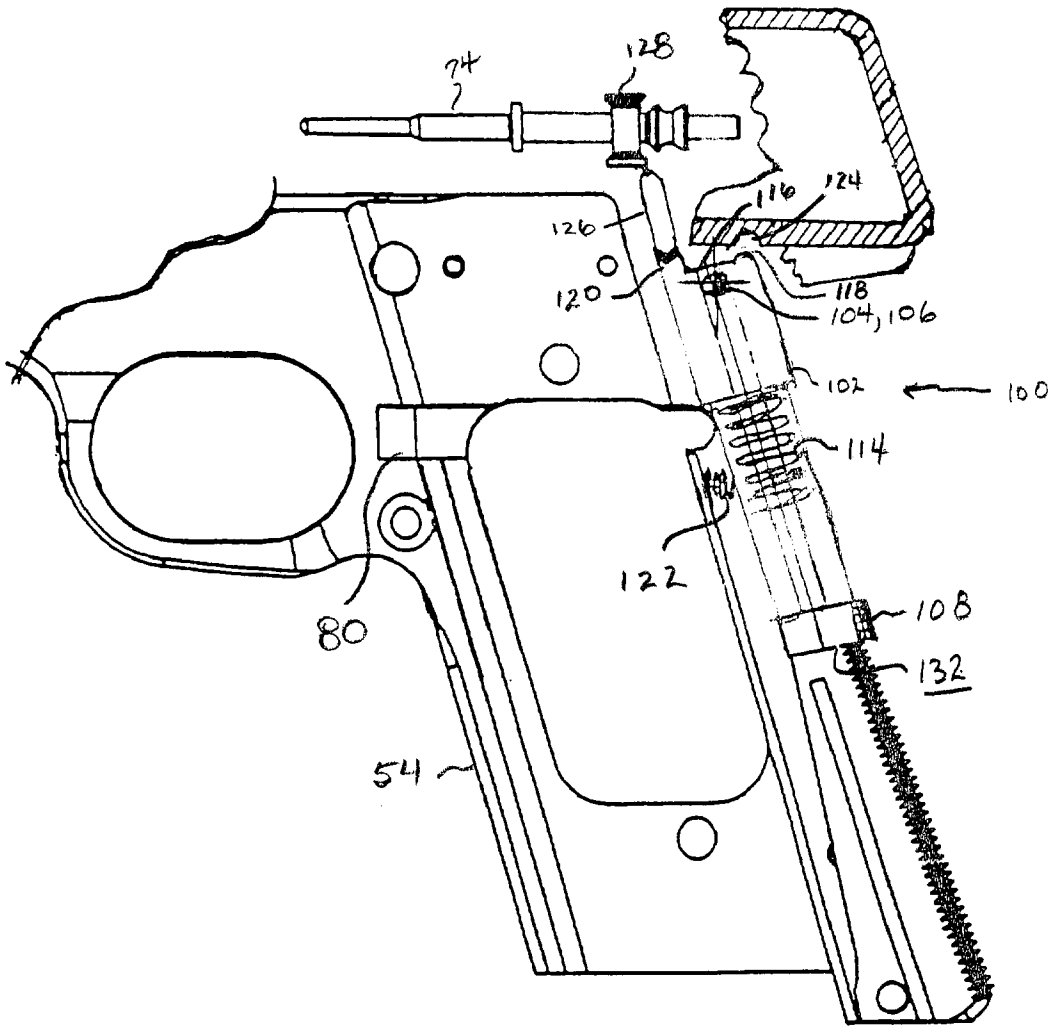
FIG. 4 is a partial side view of the pistol and safety assembly embodiment of FIG. 3 in an off-safe position.

FIGS. 3–4 depict a first embodiment of a safety assembly of the present invention generally at 100 and which includes a pivotable component such as a lock 102 pivotably mounted to the pistol 50 at a pivot point 104 by a connector 106, such as a pin commonly known to the art and an ejectable component, such as a key 108 accommodated in the lock 102 and more fully explained infra. In the embodiment depicted, the lock 102 has a biasing member, such as a lock spring 114, and an optional lock mechanism, one embodiment of the present lock mechanism is more fully explained infra.

A slide lock lug 118 and a firing pin linkage lug 120 are formed proximate an upper end 116 of the lock 102. However, a person of ordinary skill in the art will readily recognize that the present safety assembly can be readily modified without undue experimentation such that that a tensioning member is operably present as a component of the key 108, rather than as a component of the lock 102. Another tensioning member, such as a spring 122, is operably attached between the lock 102 and the pistol grip portion 54 to urge the lower portion of the lock 102 to pivot away from the grip portion 54.

FIG. 3 depicts the safety assembly 100 engaged in an on-safe position wherein the lock 102 is pivoted away from the pistol grip portion 54 by the spring 122. In the on-safe position, the slide lock lug 118 is disposed in a notch 124 of the slide 56 and the firing pin linkage lug 120 is displaced downwardly, thereby allowing a firing pin safety pushrod 126 to displace a firing pin safety 128 such that the firing pin safety 128 fixes (locks) the firing pin 74. The locked firing pin 74 cannot be displaced forwardly; hence, cannot impact the cartridge primer to initiate cartridge propellant ignition. As more fully explained infra, the lock 102 cannot be pivoted toward the pistol grip 54 until the key 108 is suitably disposed in the lock 102. In FIG. 3, the key 108 has been ejected from the lock 102 in the direction of an arrow 130 by the spring 114. The spring 114 ejects the key 108 when being allowed to return to an unbiased position from a biased position, the unbiased position being depicted in FIG. 3. In the on-safe position depicted in FIG. 3, the pushrod 126 is released, allowing the firing pin safety 128 to lock and secure the firing pin 74. The on-safe position depicted in FIG. 3 also depicts the slide lock lug 118 firmly engaged in the slide notch 124, preventing displacement of the slide 56 as well.

While the biasing members 114 and 122 are depicted as springs, a person of ordinary skill in the art will readily comprehend that the biasing members can also utilize embodiments employing other means, such as pressurized gas or magnetism to accomplish the stated functions without undue experimentation. In other embodiments, a person of ordinary skill in the art will recognize that electromagnetic and electric components may be employed as well in lieu of the springs 114 and 122.

FIG. 4 depicts the present safety assembly 100 in an off-safe position. In the off-safe position, the key 108 is disposed within the lock 102, thereby biasing the spring 114 and allowing the lock 102 to be pivoted toward the grip 54, thereby also biasing the spring 122. In the off-safe position, the key 108 is held in place against an upper edge 132 of the grip 54. However, the biased spring 122 will displace (urge) the lock 102 to the on-safe position unless held in place, e.g., by a user's hand gripping the portion 54. If the user's hand releases the grip 54, the spring 122 will pivot the lock 102 to the on-safe position and the spring 114 will eject the key 108. With the key 108 ejected, the lock 102 cannot be returned to the off-safe position unless the key 108 is reinserted. In the off-safe position, the slide lock lug 118 is displaced out of the slide notch 124 and the firing pin linkage lug 120 displaces the firing pin safety pushrod 126, thereby displacing the firing pin safety 128 to an unlocked position. When the firing pin safety 128 is in an unlocked position, the firing pin 74 is free to be displaced, e.g., by a hammer, and the pistol 50 can be operated.

Figure 5:
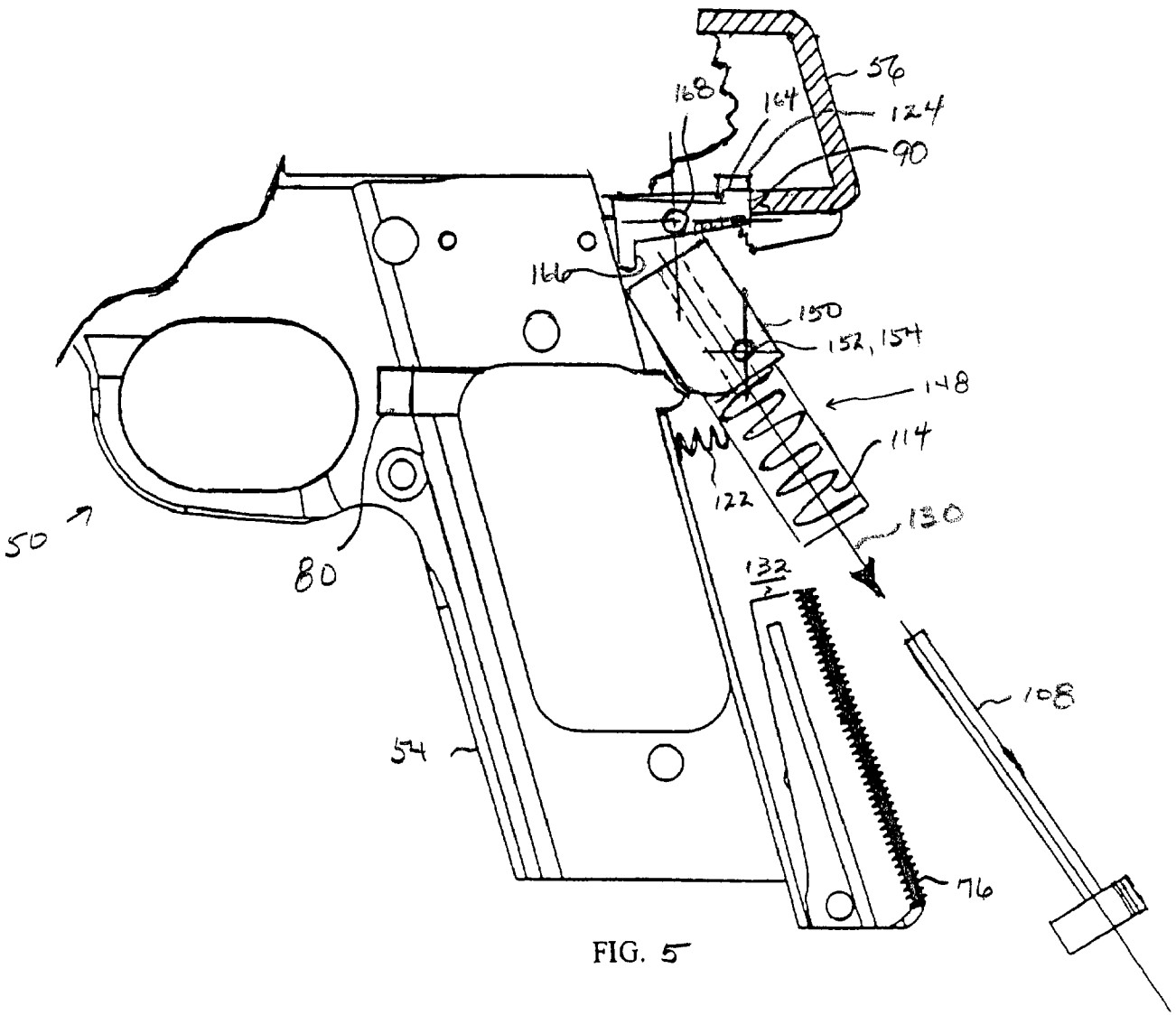
FIG. 5 is a partial side view of a pistol retrofitted or installed with a second embodiment of the present safety assembly in an on-safe position.
Figure 6:
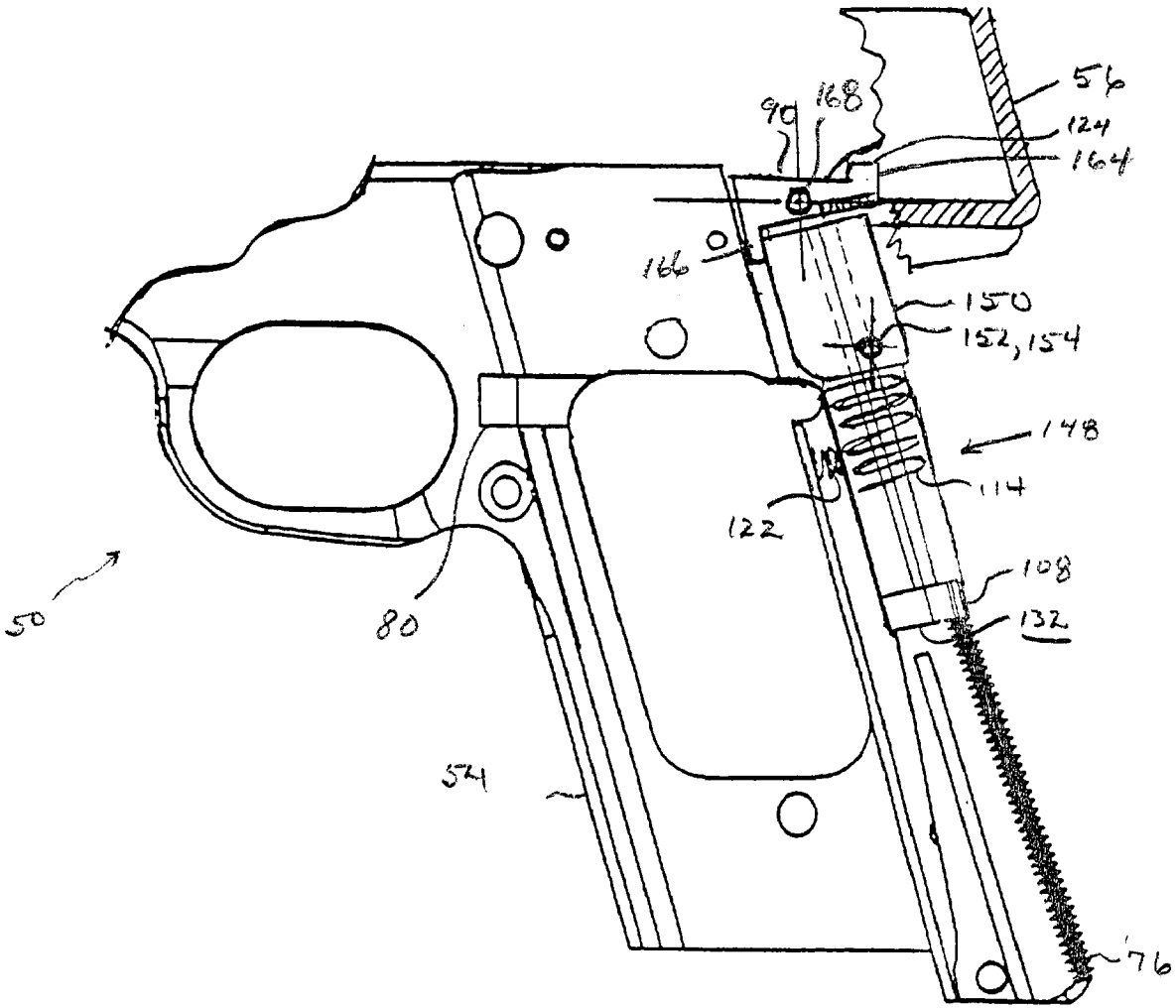
FIG. 6 is a partial side view of the pistol and safety assembly embodiment of FIG. 5 in an off-safe position.
Figure 9:
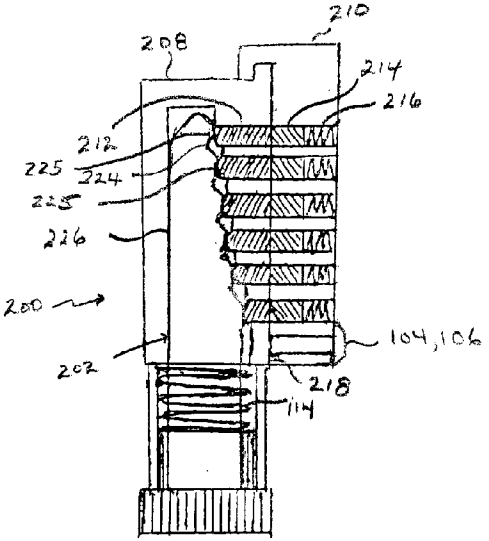
FIG. 9 is a cross sectional view of the lock and key of FIG. 7, in which the key is inserted into the lock.
Figure 7:
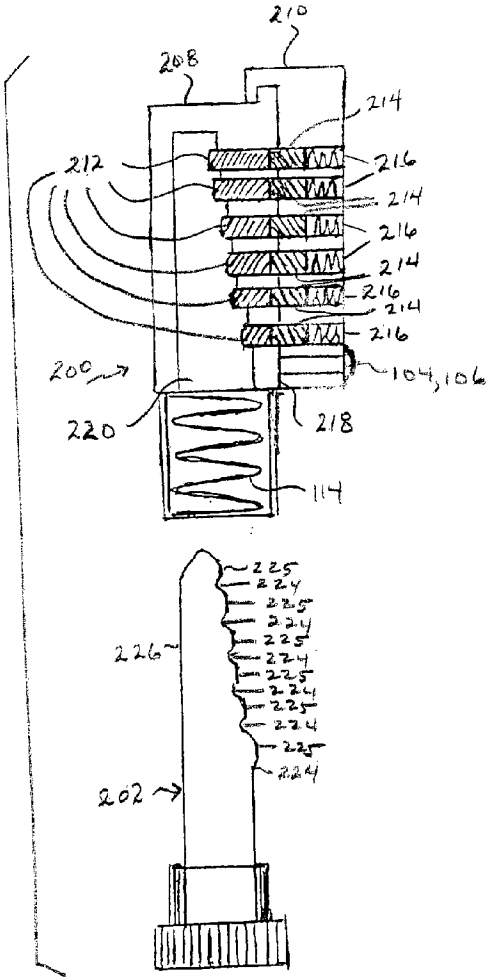
FIG. 7 is a cross sectional view of one embodiment of the present lock and key.
Figure 10:
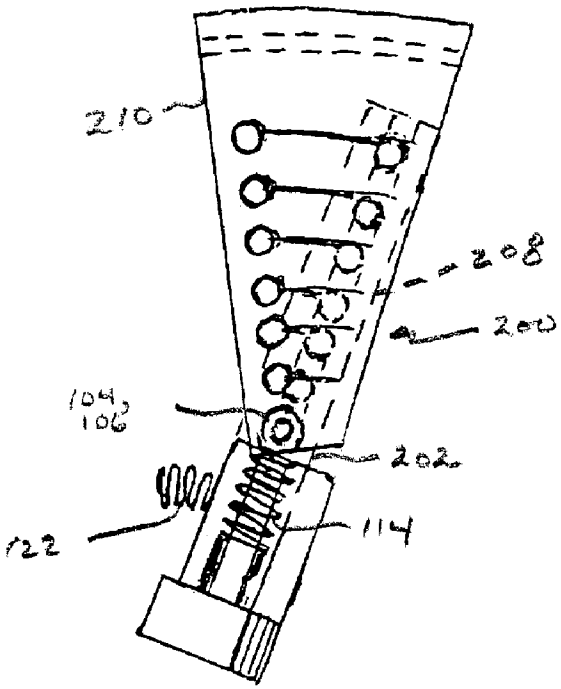
FIG. 10 is a cross sectional view of the lock and key of FIG. 7, in which the key is inserted and the lock pivoted in an off-safe position.
Figure 8:
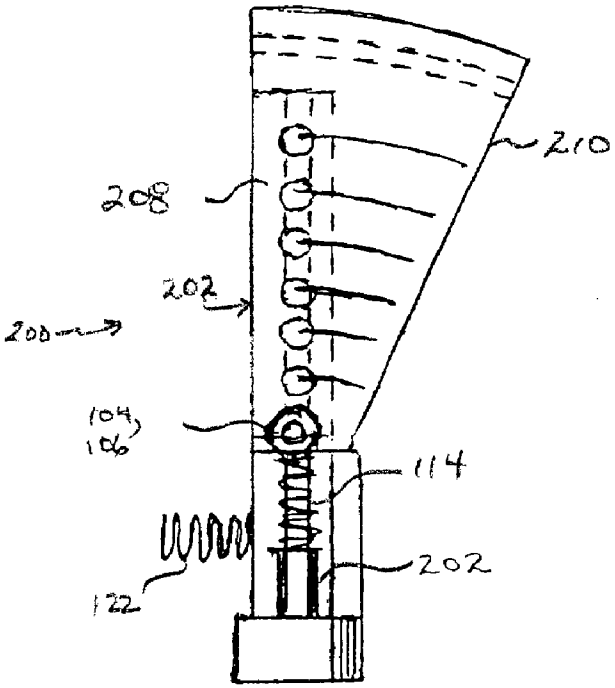
FIG. 8 is a cross sectional view of the lock and key of FIG. 6, the key inserted enabling the lock to pivot.

A second embodiment of the present safety assembly is depicted in FIGS. 5–6, generally at 148. Features unique to the safety assembly 148 include a lock 150 pivotally mounted to the pistol 50 at a pivot point 152 by a connector known to the art, such as a pin 154. The lock 150 has an upper end 160, wherein the lugs 118 and 120 of the lock 102 are not present. The lock 150 operably interacts with an external safety, such as the thumb lever safety 90, which may be modified in some embodiments. In the embodiment depicted, the thumb lever safety 90 includes lugs 164 and 166 and is pivotally mounted at 168. In some embodiments, the thumb lever safety 90 has been modified to include the internal lug 166. The lug 164 disposes in the slide notch 124, but is displaced out of the slide notch 124 when the thumb lever safety 90 is pivoted to the off-safety position. The lug 166 extends downwardly from the main body of the thumb lever safety 90 and can be operably contacted by the lock 150 as more fully explained infra.

In FIG. 5, the lock 150 has been pivoted away from the grip portion 54 when the spring 122 has been allowed to assume an unbiased disposition and the key 108 has been ejected from the lock 150 by the spring 114 in the direction of the arrow 130. The lock 150 cannot be pivoted toward the grip portion 54 until the key 108 is reinserted therein. In this position, the trigger pushrod 80 is locked to place the pistol 50 in an on-safe position, in which the trigger cannot be displaced to fire the pistol.

However, in FIG. 6, the internal lug 166 of the thumb lever safety 90 retains the lock 150 in the off-safe position when the thumb lever safety 90 is in an on-safety position. In FIG. 6, the safety assembly 148 is in an off-safe position, in which the lock 150 has been pivoted toward the grip 54, thereby compressing the spring 122. The off-safe position depicted in FIG. 6 is enabled because the thumb lever safety 90 is pivoted to an on-safety position, in which the lug 164 is disposed in the slide notch 124 and in which the trigger pushrod 80 is in an unlocked position. Because the thumb lever safety is in an on-safe position, the pistol 50 cannot be operated, whether the present safety assembly is in an on-safe or off-safe position. Thus, the lug 166 retains the lock 150 in an off-safe position, but a position in which the pistol 50 cannot be fired nonetheless. The pistol 50 can be said to be in a standby position, because the lug 164 of the thumb lever safety 90 is disposed in the slide notch 124. Moreover, the key 108 is retained in the lock 150 against the upper edge 132. In the configuration depicted by FIG. 6, the pistol 50 can be placed in a holster or released without the present safety assembly automatically assuming an on-safe position. To operate the pistol 50, the user then grips the pistol grip 54 and places the safety 90 in an off-safe position. Additionally, when the present device is in the position illustrated by FIG. 6, the slide 56 is locked by the thumb lever safety 90 and cannot be displaced until the lug 164 is moved out of the notch 124. Because the slide 56 is locked, the pistol 50 cannot be field stripped, until the lug 164 is removed from the notch 124.

Referring to FIGS. 7–10, an exemplary embodiment of the present lock and key mechanism is depicted and includes a lock 200 and a key 202. The lock 200 is one illustrative mechanism of the locks 202 and 150. The key 202 is likewise an illustrative mechanism of the present key 108.

The lock 202 includes an inner core 208 and an outer housing 210. The inner core 208 and the outer housing 210 cooperate to enclose at least one, e.g., six, inner and outer pins 212 and 214, respectively, and an identical number of corresponding pin springs 216. The inner and outer pins 212 and 214 and the pin springs are operably disposed in slots defined by a cooperation of the inner core 208 and the outer core 210. An interior of the inner core 208 defines a shear line 218 and a slot (cavity) accommodating the key 202. The key 202, in turn, has a plurality of cuts 224 defining a plurality of nodes 225, the number of nodes 225 equal to the number of inner and outer pin 212 and 214 and pin spring 216 combinations.

The lock 200 and the key 202 represent an embodiment of a step lock and step key, wherein the resistance or drag is created as the key 202 is displaced over the inner pins 212 is greatly minimized, or essentially eliminated. The lock 200 and key 202 eliminate a large portion of the friction created as the key is displaced past, thereby contacting, the inner pins 212, because the inner pins 212 are not being raised and lowered, or otherwise urged against the springs 216, as would be the case with most of the other locks known to the art. In further contrast to other locks known to the art, the key cuts 224, hence nodes 225, engage and disengage simultaneously, thereby enabling injection and ejection of the key 202 to occur more quickly and require less energy.

In contrast to keys and locks known to the art and in which all cuts, hence nodes, are fashioned at the same, or closely adjacent, planes, the cuts and nodes of the key 202 have steps beginning with the first node from the key apex. Each subsequent key cut and node defines a wider corresponding key dimension and a correspondingly narrower inner pin length, the corresponding inner pin length shortened by the same dimension. For example, if a key of the present embodiment has nine cut depths of 0.002 inch per cut, a total of 0.018 inch per step is utilized and the next, or succeeding, step present in the key would be 0.018 inch wider and the corresponding inner pin would have a dimensional length shorter than the previous adjacent pin. In the embodiment depicted, when the nodes in the keys aligned the juncture of the inner and outer pins at the shear line, the lock is unlocked, and can rotate on the pivoted 104, the inner core pivoting against a substantially flat surface of the outer housing.

While the lock 200 and key 202 are depicted as a working embodiment, a person of ordinary skill in the art will readily recognize that other lock and key embodiments would be suitable as well, e.g., if the spring 114 possessed sufficient strength to eject other embodiments of the present key.

The key-lock combinations can be individually configured for individual users or for an entire group of persons, e.g., a police or military unit.

Although the present invention has been described with reference to depicted embodiments, persons of ordinary skill in the art will readily recognize that various modifications and changes may be made without departing from the spirit and scope of the invention. For example, any number and types of safety mechanisms can be activated or deactivated by pivoting the present lock. Moreover, any number and types of safety mechanisms can be activated or deactivated by the presence or absence of the present key within the lock of this invention.

What is claimed is:

1. A safety mechanism for a firearm, comprising:

a lock, the lock cooperating with a structure firing the firearm;

an ejection mechanism; and a key, the key insertable in the lock such that the key is ejected from the lock by the ejection mechanism unless secured therein by a force exerted from a user's hand gripping the firearm, the key in a contacting disposition with respect to the lock when inserted in the lock, the key in a noncontacting disposition with respect to the lock and the firearm after being ejected, the safety mechanism being in an off-safe position when the key is present in the lock and in an on-safe position when the key is absent from the lock.

2. The mechanism of claim 1, in which the ejection mechanism is a spring.

3. The mechanism of claim 1, in which the lock is pivotably attachable to the firearm.

4. The mechanism of claim 3, in which the firearm comprises a grip and in which the lock pivots toward the grip.

5. The mechanism of claim 4, in which the firearm further comprises a slide defining a slide notch and in which the lock comprises a first lug, the first lug disposed in the slide notch when the lock is pivoted away from the grip.

6. The mechanism of claim 5, in which disposing the first lug in the slide notch prevents the firearm from being field stripped until the first lug is removed from the slide notch.

7. The mechanism of claim 5, in which the firearm further comprises a firing pin safety pushrod, a firing pin safety, and a firing pin and in which the lock comprises a second lug, the second lug displacing the firing pin safety pushrod and the firing pin safety to secure the firing pin in an on-safe position when the lock is pivoted away from the grip.

8. The mechanism of claim 4, in which the firearm comprises a firing pin safety pushrod, a firing pin safety, and a firing pin, and in which the lock comprises a lug, the lug displacing the firing pin safety pushrod and the firing pin safety to secure the firing pin in an on-safe position when the lock is pivoted away from the grip.

9. The mechanism of claim 4, in which the firearm comprises a slide defining a notch and a safety with a first lug, the safety pivotally mounted proximate the slide, the safety first lug disposing in the slide notch when in an on-safe position.

10. The mechanism of claim 9, in which the safety comprises a second lug, the safety second lug securing the lock against the grip when in an off-safe position.

11. The mechanism of claim 1, in which the key is ejected from the lock as the lock pivots away from the firearm.

12. The mechanism of claim 1, further comprising a spring biasing the lock away from the firearm.

13. A firearm comprising a firing pin and the safety mechanism of claim 1 in mechanical communication with the firing pin.

14. The firearm of claim 13, wherein said firearm is a pistol.

15. The firearm of claim 13, wherein said firearm is a semi-automatic pistol.

16. A process of installing or retrofitting a pivotable safety assembly in a firearm, the process comprising:

pivotably affixing a lock to said firearm, the lock cooperating with a structure firing the firearm and comprising an ejection mechanism;

biasing said lock away from said firearm; and providing a key, the key insertable into said lock such that the key is ejected from the lock by the ejection mechanism unless secured therein by a force exerted from a user's hand gripping the firearm, the key in a contacting disposition with respect to the lock when inserted in the lock the key in a noncontacting disposition with respect to the lock and the firearm after being ejected, the safety mechanism being in and off-safe position when the key is present in the lock and in an off-safe position when the key is absent from the lock.

17. The process of claim 16, in which the lock comprises a first lug, the first lug disposable in a firearm slide notch when the lock is pivoted away from said firearm.

18. The process of claim 17, in which the lock further comprises a second lug, the second lug contacting a firing pin safety pushrod, the firing pin safety pushrod in mechanical communication with the firing pin, the second lug thereby locking a firing pin of the firearm in an on-safe position when the lock is pivoted away from said firearm.

19. The process of claim 16, in which the lock comprises a lug contacting a firing pin safety pushrod, the firing pin safety pushrod in mechanical communication with a firing pin of the firearm the lug thereby locking the firing pin in an on-safe position when the lock is pivoted away from said firearm.

20. The process of claim 16, the firearm comprising an external safety, the external safety comprising a first lug retaining the lock adjacent said firearm when said external safety is in an on-safe position.

* * * * *